US006931695B2

(12) United States Patent
Anscher

(10) Patent No.: US 6,931,695 B2
(45) Date of Patent: Aug. 23, 2005

(54) BUCKLE WITH PUSH BUTTON RELEASE

(76) Inventor: Joseph Anscher, 1928 Midlane, Muttontown, NY (US) 11791

( * ) Notice: Subject to any disclaimer, the term of this patent is extended or adjusted under 35 U.S.C. 154(b) by 0 days.

(21) Appl. No.: 10/740,128

(22) Filed: Dec. 18, 2003

(65) Prior Publication Data

US 2005/0132545 A1 Jun. 23, 2005

(51) Int. Cl.[7] ..... A44B 11/25
(52) U.S. Cl. ..... 24/614; 24/615; 24/662
(58) Field of Search ..... 24/614–621, 625, 24/629, 633, 662

(56) References Cited

U.S. PATENT DOCUMENTS

| | | | | |
|---|---|---|---|---|
| 4,679,282 A | * | 7/1987 | Feng | 24/614 |
| 4,831,694 A | * | 5/1989 | Kong | 24/625 |
| 4,866,819 A | * | 9/1989 | Kasai | 24/614 |
| 5,533,240 A | * | 7/1996 | Murai | 24/615 |
| 5,551,131 A | * | 9/1996 | Anscher | 24/614 |
| 5,604,964 A | * | 2/1997 | Aoshima | 24/632 |
| 5,791,026 A | * | 8/1998 | Anscher | 24/615 |
| D401,533 S | | 11/1998 | Anscher | D11/218 |
| 5,855,057 A | | 1/1999 | Anscher | 24/614 |
| 5,974,637 A | * | 11/1999 | Tracy et al. | 24/633 |
| 6,408,494 B1 | * | 6/2002 | Anscher | 24/625 |
| 6,606,770 B1 | * | 8/2003 | Badrenas Buscart | 24/625 |
| 6,796,007 B1 | * | 9/2004 | Anscher | 24/633 |

FOREIGN PATENT DOCUMENTS

JP 2003-93113 A * 4/2003

* cited by examiner

*Primary Examiner*—Robert J. Sandy
*Assistant Examiner*—Ruth C. Rodriguez
(74) *Attorney, Agent, or Firm*—Collard & Roe, P.C.

(57) ABSTRACT

A buckle comprises a male portion, a female portion and a push button. The male portion comprises a base and at least one locking leg having a release tab. The female portion comprises a hollow body and a catch for locking the locking leg to the female portion when the male portion is inserted into the female portion. The push button is inserted into the female portion and is adapted to move longitudinally toward and away from the male portion. The push button has a base, a spring mounted on an inside surface of the base and at least one release prong. Depressing the push button causes the release prong to slide between the catch and the release tab, to release the release tab from the catch, and causes the spring to push against the male portion and eject the male portion from the female portion.

14 Claims, 7 Drawing Sheets

BUCKLE WITH PUSH BUTTON RELEASE

BACKGROUND OF THE INVENTION

1. Field of the Invention

This invention relates to a buckle that can be released by pressing a button on a bottom section of the buckle. In particular the invention relates to a buckle that has the internal structure and strength of a side-release buckle, but the ease of release of a center-push buckle.

2. The Prior Art

There are two common types of buckles used to connect two items together: a center-push buckle and a side-release buckle. In the center push buckle, the buckle is released by pressing a button located on a center of the female portion of the buckle. Depressing the button causes the male portion of the buckle to be ejected out from the female portion. An example of a center-push type buckle can be seen in U.S. Pat. No. 5,855,057 to Anscher. In a side-release buckle, the male portion has two locking legs that snap into slots on the side of the female portion. Depressing the locking legs toward each other causes the male portion to be ejected from the female portion. An example of a side-release buckle can be seen in U.S. Design Pat. No. D401,533 to Anscher. The mechanisms of typical side release and center push buckles are well known in the art and are not discussed in detail here.

Center push buckles are very convenient to use, because they can be depressed with a single finger. However, the perpendicular pressure required on the buckle can be awkward, especially if the buckle is used for a belt or on a briefcase. This is because if the pressure is exerted toward a soft surface, the buckle may just move toward the surface and not release. Side-release buckles are often sought after because they are generally more durable and can withstand more tension that center-push buckles. Side-release buckles can also be used on briefcases and belt applications, because the pressure is exerted parallel to the surface against which the buckle rests, and is not affected by the softness of the surface. However, side release buckles can be inconvenient to use because they require two fingers to release.

SUMMARY OF THE INVENTION

It is therefore an object of the invention to provide a buckle that has the strength and durability of a side release buckle, yet the convenience of operation of a center-push buckle.

It is another object of the invention to provide a buckle that can be conveniently used on briefcases, backpacks and belts, where the buckle rests against a soft surface.

These and other objects are accomplished by a buckle comprising a male portion, a female portion and a push button. The male portion comprises a base, a center leg connected to the base, and at least one locking leg having a release tab. The female portion comprises a hollow body with two open ends and a catch for locking the locking leg to the female portion when the male portion is fully inserted into the female portion through a first end. The push button is inserted into the female portion through a second end and is adapted to move longitudinally toward and away from the male portion when the male portion is inserted in the first open end. The push button has base having an external face adapted to be pressed by a finger and at least one release prong connected to the base. Depressing the push button when the male portion is locked into the female portion causes the release prong to slide between the catch and the release tab, to release the release tab from the catch.

In a preferred embodiment, the push button has a spring mounted on an inside surface of the base and extending toward the first open end of the female portion, so that pressing the push button causes the spring to push against the center leg of the male portion and eject the male portion from the female portion, simultaneous with the release of the release tabs.

In a preferred embodiment, there are two locking legs disposed on opposite sides of the center leg, and two catches disposed on the female portion, so that each locking leg is locked to the female portion by one catch. There are also two release prongs connected to the base of the push button, each release prong adapted to release one of the locking legs from a corresponding catch.

The center leg preferably has a transverse plate mounted at its free end and the spring preferably has a transverse plate mounted at an end facing the male portion. The two plates are biased against each other when the male portion is locked into the female portion and the push button is depressed.

In a preferred embodiment, the push button is locked to the female portion so that it cannot be removed from the female portion, yet is still able to move toward and away from the first open end while mounted inside the female portion. The push button is preferably locked into the female portion via a pair of flexible latches on the push button and a pair of ledges on the female portion. The flexible latches spring outward once the push button is inserted into the female portion and rest against the ledges to prevent the push button from exiting the female portion.

To facilitate locking the male portion to the female portion, there is a guide groove located on the center leg, and a corresponding guide track located on the female portion. The guide groove engages the guide track when the male portion is inserted into the female portion, to guide the male portion in a straight line through the female portion. Alternatively, the guide track could be on the center leg of the male portion and the guide groove could be on the female portion.

If the buckle is to be permanently mounted to a surface such as a briefcase or a backpack, a mounting plate is provided. The mounting plate has a locking device adapted to receive a corresponding locking device on an outside of the female portion, to mount the female portion to a surface. The locking device on the female portion is preferably a protrusion, and the locking device on the mounting plate is preferably an aperture and a flexible leg with an abutting portion. The protrusion on the female portion fits into the aperture and is held in place by the abutting portion on the flexible leg.

There is preferably a strap attaching bar connected to the male portion, to allow a strap to be connected to the male portion. There could also be two bars, in case it is desired for the strap to be adjustable.

The release tab on the male portion preferably comprises a hook portion that engages the catch on the female portion when the male portion is fully inserted into the female portion.

The spring preferably comprises two flexible legs extending from the base of the push button to an end, the legs being connected to each other at the end. Depressing the push button causes the legs to each bend outward and away from each other, thus placing the spring into a biased condition. Releasing the spring causes the legs to flex back toward each other to a resting position. Other types of springs, such as coil springs, or any other suitable type of spring, could also be used.

The release prong on the push button preferably comprises a sloped end portion that slides along the release tab when the push button is depressed, to move the release tab away from the catch and allow the male portion to be ejected from the female portion.

The buckle according to the invention has all the advantages in terms of strength and durability of a side-release buckle, but with the convenience of a center-push buckle.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
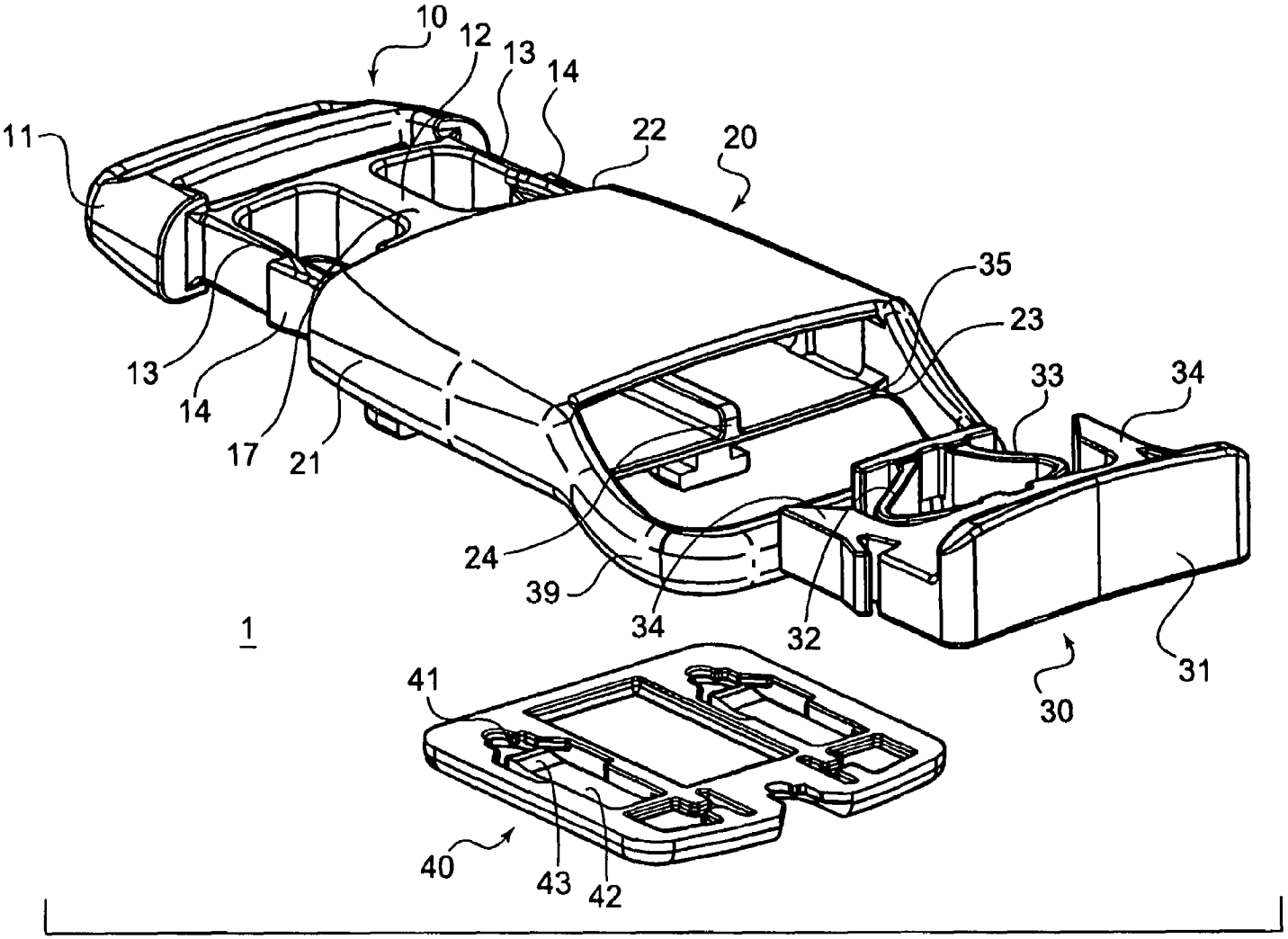
FIG. 1 shows an exploded view of a preferred embodiment of the buckle according to the invention.

Referring now in detail to the drawings, FIG. 1 shows the buckle 1 according to the invention. Buckle 1 comprises a male portion 10, a female portion 20, a push button 30 and an optional mounting plate 40. Male portion 10 has a base 11, a center leg 12 and two side locking legs 13. Each locking leg 13 has a release tab 14 at its free end. At the free end of center leg 12 is a transverse plate 15.

Female portion 20 comprises a hollow body 21 with a first end 22 and a second end 23. Push button 30 comprises a base 31, a spring comprised of flexible legs 32, 33, and two release prongs 34. Flexible legs 32, 33 are connected at their bottom ends to base 31, and at their top ends to a transverse plate 35. An optional mounting plate 40 is provided, if female portion 20 of buckle 1 is to be mounted on a fixed surface, such as on a briefcase.

Figure 2:
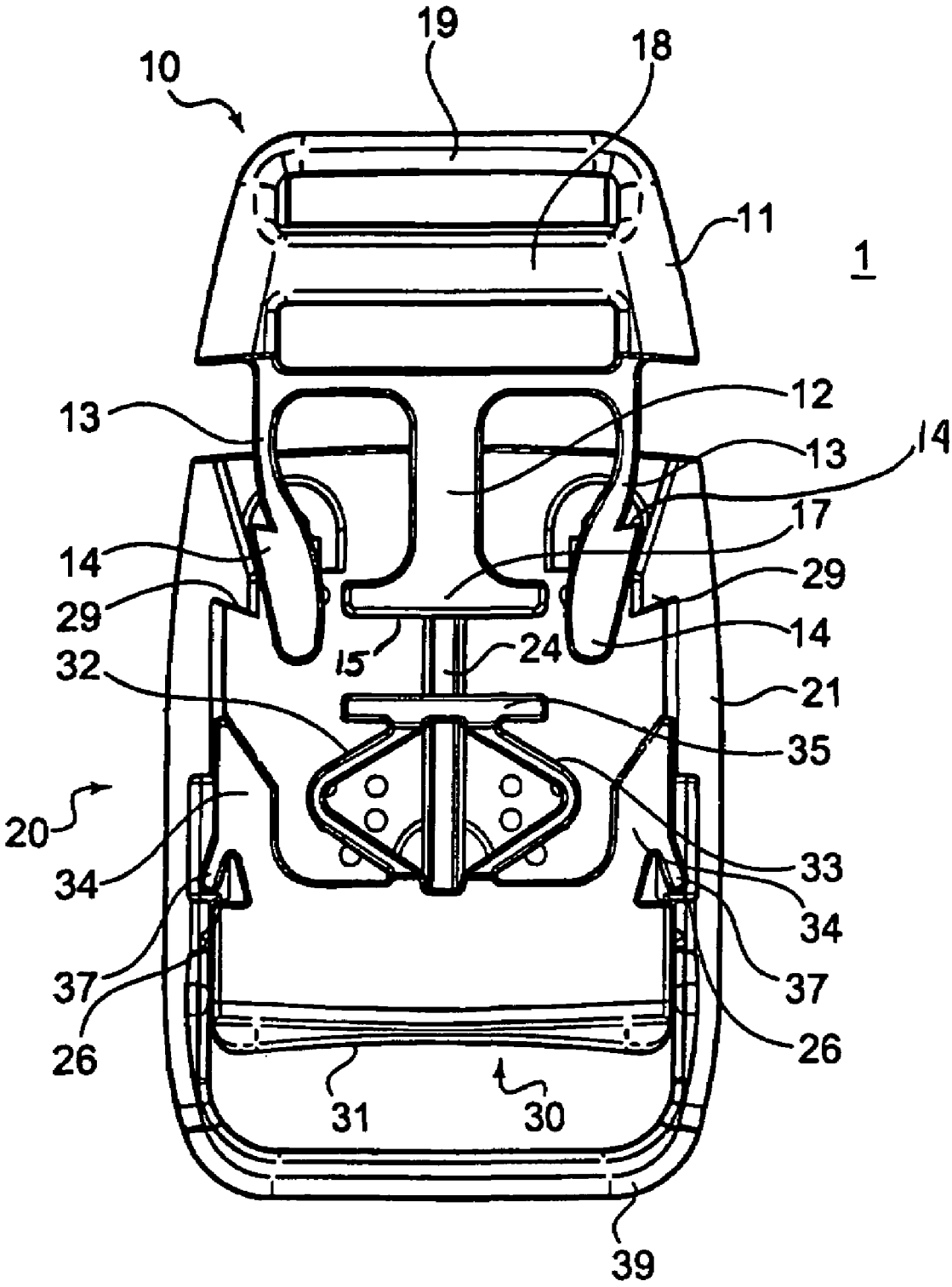
FIG. 2 shows a top sectional view along lines II—II of the buckle of FIG. 1 in a pre-locked position.

FIG. 2 shows a sectional view of buckle 1 in an assembled, pre-locked position. Push button 30 is installed within female portion 20 by pushing button 30 through second end 23. Flexible latches 37, once they clear second end 23, spring outward and abut ledge 26 of female portion 20, to lock push button 30 within female portion 20. Push button 30 can still move toward and away from male portion 10, which is inserted through first end 22 of female portion 20. To help guide male portion 10 into female portion 20, center leg 12 is equipped with a groove 17 that engages a guide track 24 on the inside of female portion 20.

Figure 3:
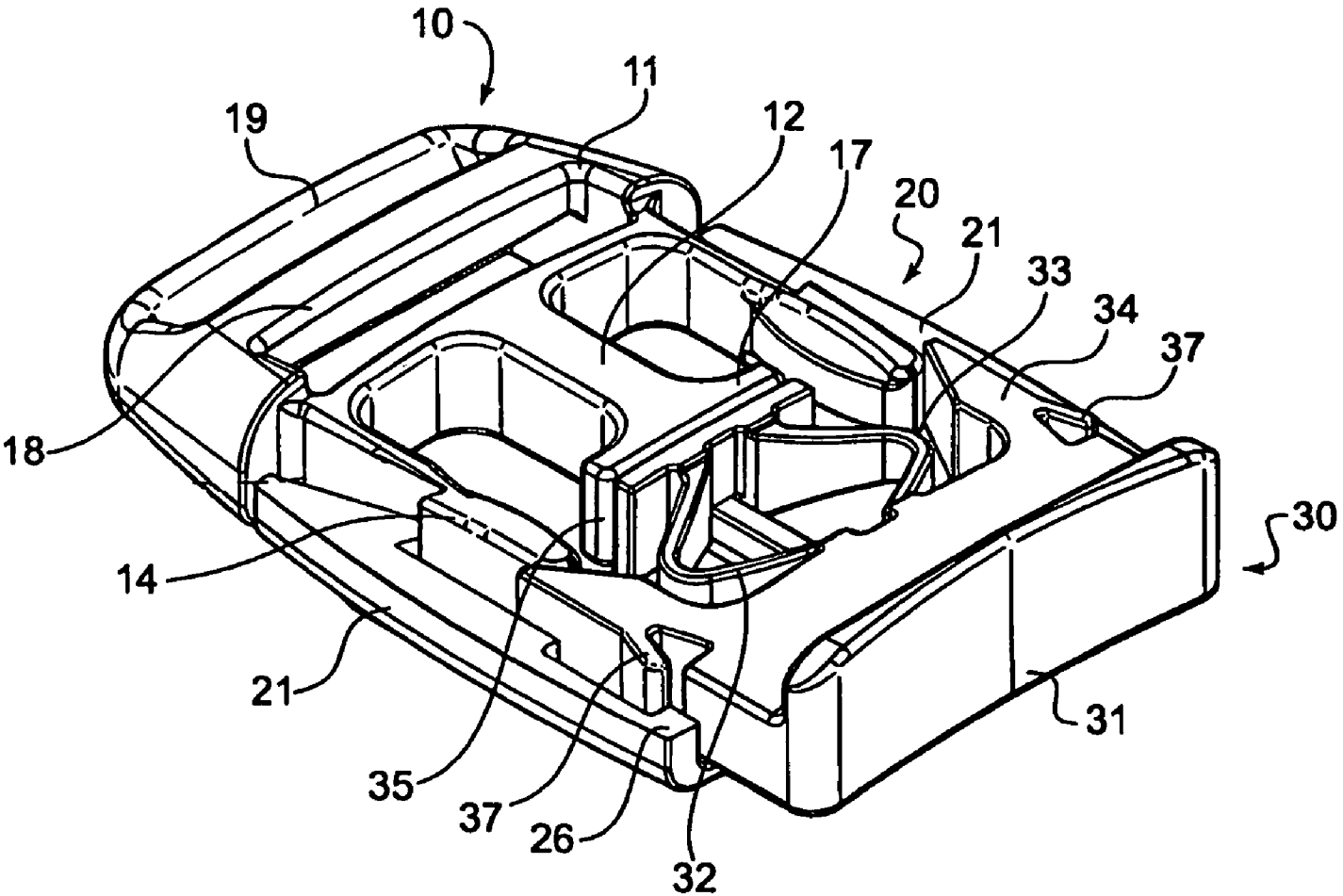
FIG. 3 shows a perspective view along lines II—II of the buckle of FIG. 1 in a locked position.
Figure 4:
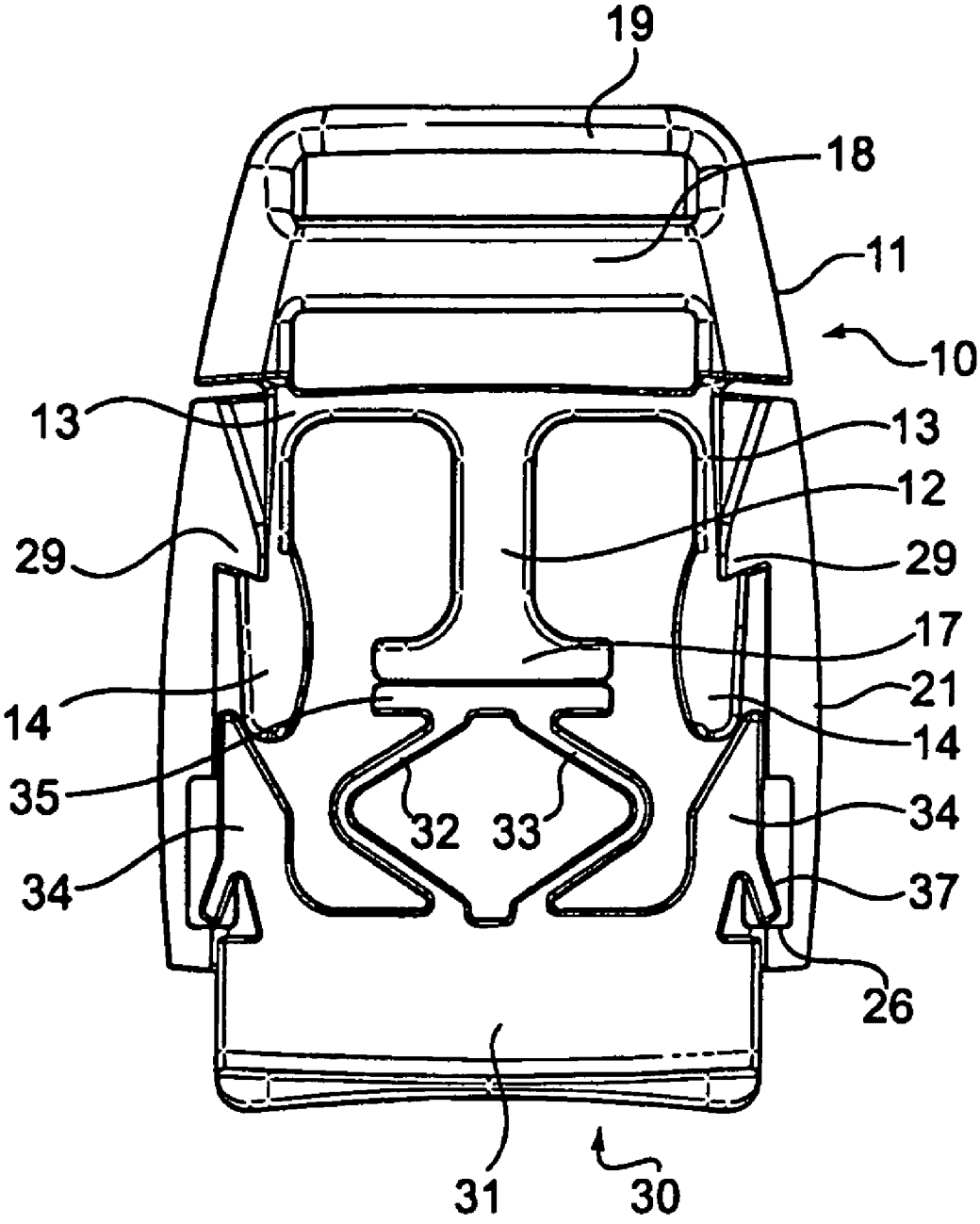
FIG. 4 shows a top view of the buckle of FIG. 3.

As shown in FIGS. 3 and 4, when male portion 10 is fully inserted into female portion 20, release tabs 13 are locked into female portion 20 via hook portions 14 interacting with catches 29 on female portion 20. At this point, transverse plate 15 of center leg 12 rests against transverse plate 35, that is disposed on top of the spring formed by flexible legs 32, 33. At this point, buckle 1 is locked in the same manner as a conventional side-release buckle. The only difference is that release tabs 13 do not extend through to the outside of female portion 20 as with conventional side-release buckles.

Figure 5:
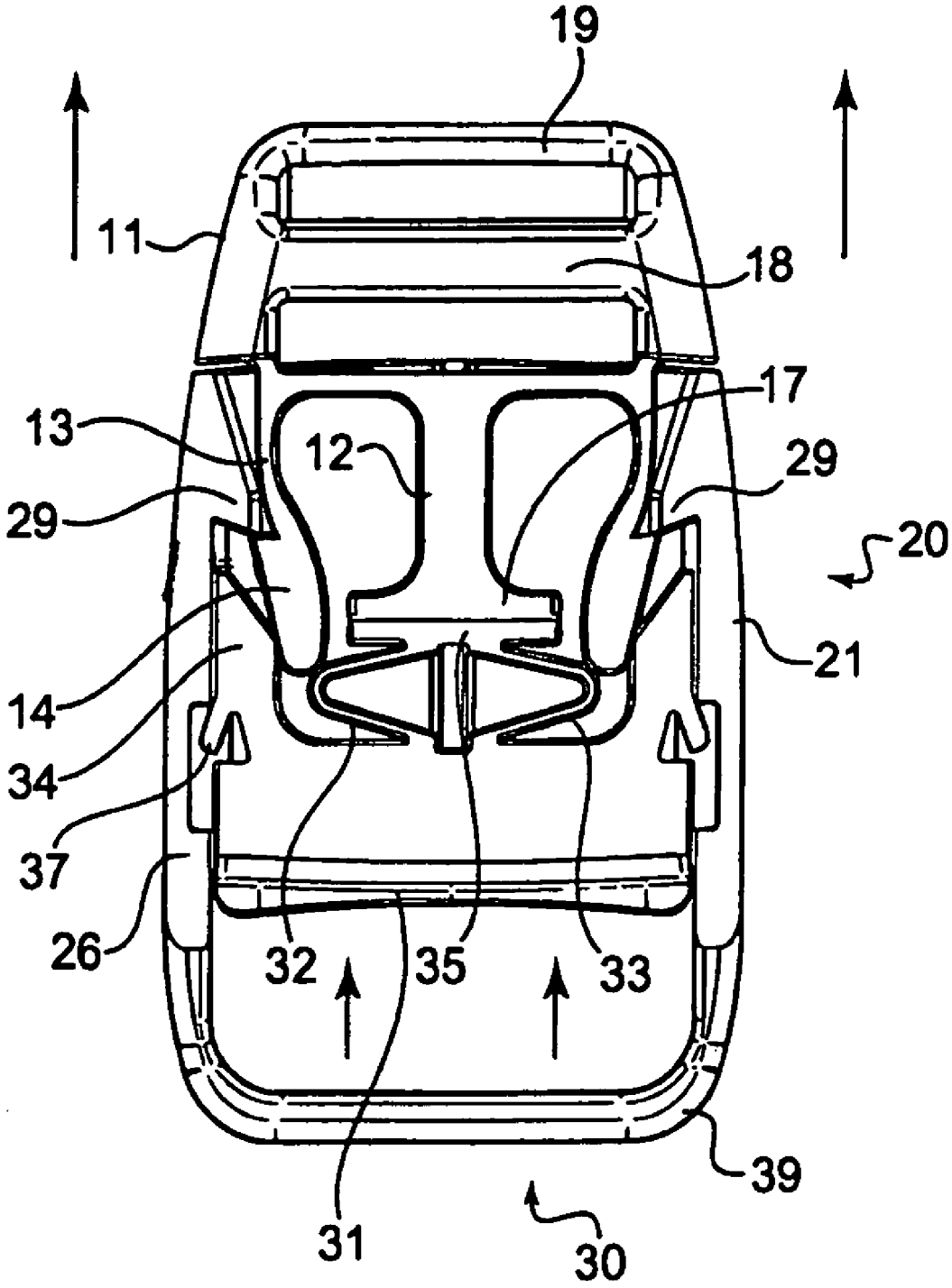
FIG. 5 shows a top sectional view along the lines II—II of FIG. 1, with the push button depressed.

FIG. 5 shows buckle 1 in an initial release position. Here, push button 30 is depressed by pressing against base 31, which causes button 30 to move toward male portion 10. This causes the spring formed by legs 32, 33, to compress and place pressure against transverse plate 15 of center leg 12 of male portion 10. At the same time, release prongs 34 slide up in between release tabs 13 and catches 29, to unlock male portion 10 from female portion 20. Then, the pressure from legs 32, 33 against male portion 10 forces male portion 10 out of female portion 20 to release buckle 1. Thus, buckle 1 is released with a single push of a button. In addition, because the pushing action occurs parallel to the lateral face of buckle 1, buckle 1 is ideal for mounting on soft surfaces such as briefcases, backpacks and belts. Pressure against push button 30 is thus directed parallel to buckle 1, and is not forced against the soft surface of the briefcase or a body.

If male portion 10 is to be attached to a strap, strap attachment bars 18, 19 are provided on male portion 10. A length of webbing can be threaded through bars 18, 19 to attach the webbing to male portion 10 in an adjustable manner.

As shown in FIGS. 1, 2 and 5, female portion 20 can also be equipped with a strap retaining bar 39, to attach female portion to a strap. This is important if buckle 1 is to be used as a belt buckle.

Figure 6:
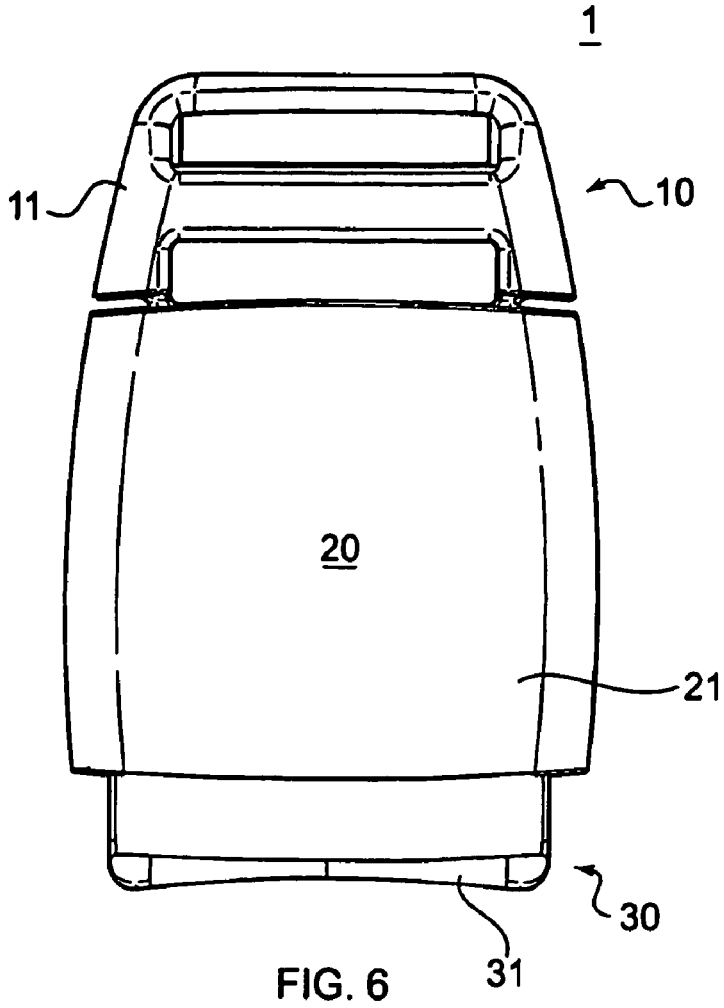
FIG. 6 shows a top view of the buckle of FIG. 1 in a locked position.
Figure 8:
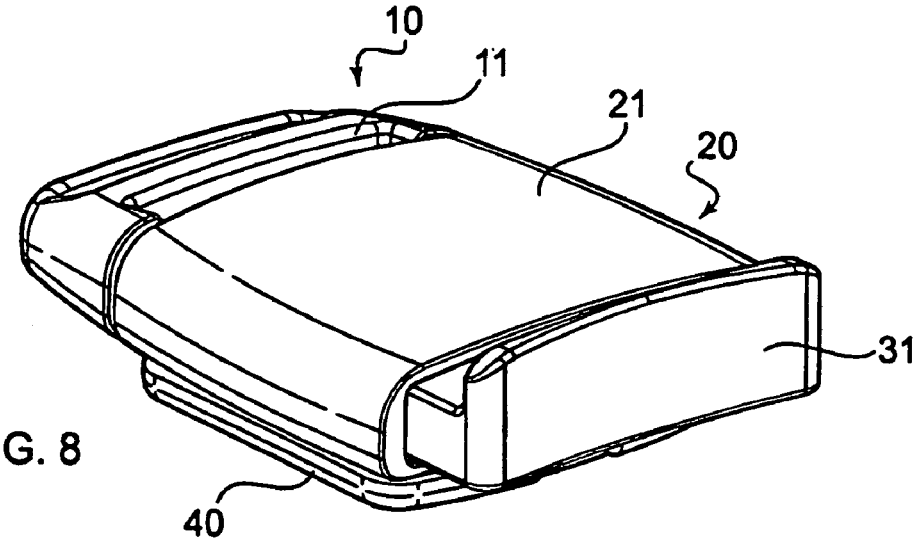
FIG. 8 shows a perspective view of the buckle of FIG. 7.
Figure 7:
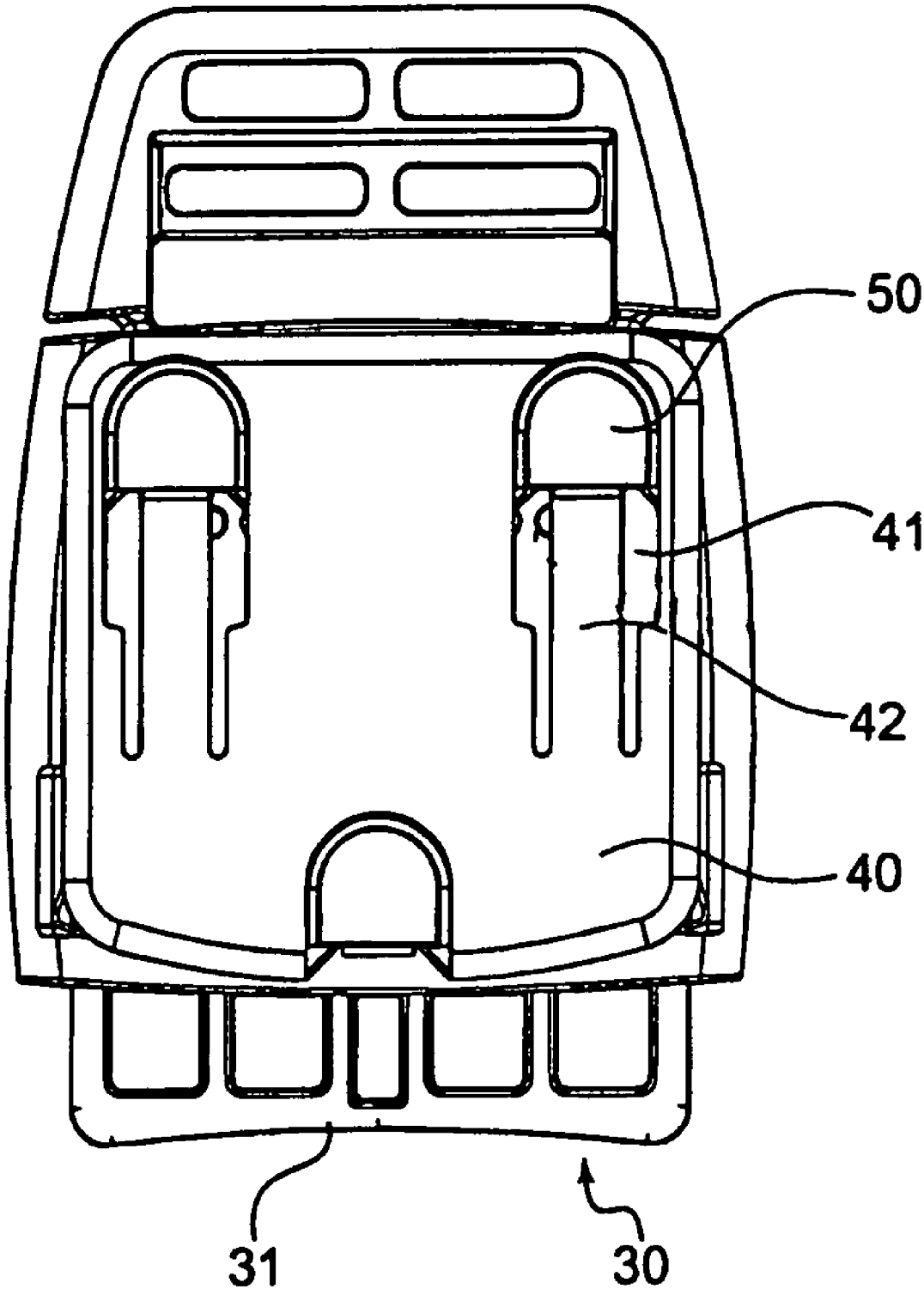
FIG. 7 shows a bottom view of the buckle of FIG. 1 in a locked position and mounted to a mounting plate.

FIGS. 6–8 show buckle 1 in a fully assembled position, with mounting plate 40 connected to female portion 20. As shown in FIG. 7, mounting plate 40 comprises two apertures 41, and flexible legs 42, each having an abutting portion 43, adjacent apertures 41. Female portion 20 has two protrusions 50, which correspond in location to the location of apertures 41 on mounting plate 40. To mount female portion 20 to mounting plate 40, protrusions 50 are inserted into apertures 41. Abutting portions 43 abut protrusions 50 and keep female portion 20 connected to mounting plate 40.

Accordingly, while only a single embodiment of the present invention has been shown and described, it is obvious that many changes and modifications may be made thereunto without departing from the spirit and scope of the invention.

What is claimed is:

1. A buckle comprising:

a male portion, comprising a base, at least one locking leg connected to the base, said locking leg having a release tab;

a female portion comprising a hollow body with a catch for locking the locking leg to the female portion when the male portion is fully inserted into the female portion, said female portion further comprising a first opening and a second opening, said openings being located opposite one another; and a push button inserted into the first opening of the female portion, said push button adapted to move longitudinally toward and away from the male portion when said male portion is inserted into the second opening of the female portion, said push button further comprising:

(a) a base having an external face adapted to be pressed by a finger; and (c) at least one release prong connected to the base;

wherein depressing the push button when said male portion is locked into said female portion causes said release prong to release said release tab from the catch.

2. The buckle according to claim 1, wherein the push button assembly further comprises a spring mounted on an inside surface of said base, wherein depressing the push button causes the spring to push against the male portion and eject the male portion from the female portion.

3. The buckle according to claim 1, wherein there are two locking legs, and two catches disposed on said female portion, so that each locking leg is locked to the female portion by one catch, and further comprising two release prongs connected to the base of the push button, each release prong adapted to release one of the locking legs from a corresponding catch.

4. The buckle according to claim 2, wherein the male portion further comprises a center leg extending from the base, said center leg having a transverse plate mounted at its free end, and wherein the spring has a transverse plate mounted at an end facing the male portion, said two plates contacting each other when said male portion is locked into said female portion and said push button is depressed.

5. The buckle according to claim 1, wherein the push button is locked to the female portion so that it cannot be removed from the female portion.

6. The buckle according to claim 4, further comprising a guide groove located on said center leg, and a corresponding guide track located on said female portion, said guide groove engaging said guide track when said male portion is inserted into said female portion, to guide said male portion in a straight line through said female portion.

7. The buckle according to claim 1, further comprising a mounting plate adapted to be secured to a surface, said mounting plate having a locking device adapted to receive a corresponding locking device on an outside of said female portion, to mount the female portion to a surface.

8. The buckle according to claim 1, further comprising at least one strap attaching bar connected to at least one of said male portion and said female portion, to allow at least one strap to be connected to said buckle.

9. The buckle according to claim 1, wherein said at least one release tab comprises a hook portion that engages said at least one catch when said male portion is fully inserted into said female portion.

10. The buckle according to claim 2, wherein said spring comprises at least one flexible leg extending from said base to an end, wherein depressing the push button causes the at least one to flex and exert pressure on the male portion.

11. The buckle according to claim 10, wherein there are two flexible legs, said legs being connected to each other at said end, wherein depressing the push button causes the legs to each bend outward and away from each other.

12. The buckle according to claim 1, wherein said at least one release prong comprises a sloped end portion, said sloped end portion sliding along said at least one release tab when said push button is depressed, to move said at least one release tab away from said at least one catch and release the male portion from the female portion.

13. The buckle according to claim 5, wherein the push button is locked into the female portion via a pair of flexible latches on the push button and a pair of ledges on the female portion, said flexible latches springing outward once the push button is inserted into the female portion and resting against the ledges to prevent the push button from exiting the female portion.

14. The buckle according to claim 7, wherein the locking device on the female portion is a protrusion, and the locking device on the mounting plate is an aperture and a flexible leg with an abutting portion, said protrusion fitting into said aperture and being held in place by said abutting portion on said flexible leg.

* * * * *